US008217291B2

(12) United States Patent
Gottschalk et al.

(10) Patent No.: US 8,217,291 B2
(45) Date of Patent: Jul. 10, 2012

(54) ELECTRICAL SWITCHING APPARATUS AND STATUS INDICATING ASSEMBLY THEREFOR

(75) Inventors: Andrew Lawrence Gottschalk, Pittsburgh, PA (US); Robert Michael Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 223 days.

(21) Appl. No.: 12/717,421

(22) Filed: Mar. 4, 2010

(65) Prior Publication Data

US 2011/0214975 A1 Sep. 8, 2011

(51) Int. Cl.
*H01H 5/00* (2006.01)

(52) U.S. Cl. ..... 200/400

(58) Field of Classification Search ..... 200/400, 200/401, 500–501, 318, 323–325, 293, 573–574, 200/303, 307–308, 337; 340/653
See application file for complete search history.

(56) References Cited

U.S. PATENT DOCUMENTS

| | | | | |
|---|---|---|---|---|
| 5,973,278 | A * | 10/1999 | Wehrli et al. | 200/308 |
| 6,080,947 | A * | 6/2000 | Ulerich et al. | 200/308 |
| 6,144,002 | A * | 11/2000 | Coudert et al. | 200/400 |
| 6,788,172 | B1 * | 9/2004 | Godesa et al. | 335/17 |
| 7,449,653 | B2 | 11/2008 | Gibson et al. | |
| 7,459,650 | B2 | 12/2008 | Weister et al. | |
| 7,518,076 | B1 | 4/2009 | Gottschalk et al. | |
| 7,598,467 | B2 | 10/2009 | Gibson et al. | |
| 7,696,448 | B2 * | 4/2010 | Rakus et al. | 200/400 |
| 7,985,936 | B2 * | 7/2011 | Ahn | 200/308 |

* cited by examiner

*Primary Examiner* — Edwin A. Leon
(74) *Attorney, Agent, or Firm* — Dawn C Wolff; Martin J. Moran

(57) ABSTRACT

A status indicating assembly is provided for an electrical switching apparatus, such as a circuit breaker. The circuit breaker includes a housing, separable contacts enclosed by the housing, and an operating mechanism for opening and closing the separable contacts. The operating mechanism comprises a stored energy mechanism and a primary latch. The primary latch is pivotable between a latched position corresponding to the stored energy mechanism being chargeable, and an unlatched position corresponding to the stored energy mechanism being discharged. The status indicating assembly includes a first indicator for indicating whether the separable contacts are open or closed, a second indicator for indicating whether the stored energy mechanism is charged or discharged, and a third indicator for indicating whether or not the circuit breaker is ready to close the separable contacts.

20 Claims, 11 Drawing Sheets

ELECTRICAL SWITCHING APPARATUS AND STATUS INDICATING ASSEMBLY THEREFOR

BACKGROUND

1. Field

The disclosed concept relates generally to electrical switching apparatus and, more particularly, to electrical switching apparatus, such as circuit breakers. The disclosed concept also relates to status indicating assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some power circuit breakers, for example, typically include a pole shaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the pole shaft. Elements of both the closing assembly and the opening assembly, which are also pivotably coupled to the pole shaft, pivot the pole shaft in order to effectuate the closing and opening of the electrical contacts. A chargeable stored energy mechanism such as, for example and without limitation, a closing spring, facilitates the closing process.

Generally, such circuit breakers only include indicia (e.g., without limitation, flags or other suitable visual indicators) for providing a visual indication of the open/closed status of the separable contacts of the circuit breaker, and the charged/discharged status of the stored energy mechanism of the circuit breaker. This can lead to operator confusion, for example and without limitation, if the circuit breaker fails to close when the close button is pushed, and it is unknown whether the failure to close is due to a correctly operating interlock, or because there has been a malfunction. In other words, no visual indication is provided for determining whether the breaker is truly ready to close.

There is, therefore, room for improvement in electrical switching apparatus, such as circuit breakers, and in status indicating assemblies therefor.

SUMMARY

These needs and others are met by embodiments of the disclosed concept, which are directed to a status indicating assembly for an electrical switching apparatus, such as a circuit breaker. Among other benefits, the status indicating assembly provides a substantially direct indication of the circuit breaker latch status by coupling a ready to close flag to the primary latch.

As one aspect of the disclosed concept, a status indicating assembly is provided for an electrical switching apparatus. The electrical switching apparatus includes a housing, separable contacts enclosed by the housing, and an operating mechanism for opening and closing the separable contacts. The operating mechanism comprises a stored energy mechanism and a primary latch. The primary latch is pivotable between a latched position corresponding to the stored energy mechanism being chargeable, and an unlatched position corresponding to the stored energy mechanism being discharged. The status indicating assembly comprises: a first indicator structured to indicate whether the separable contacts are open or closed; a second indicator structured to indicate whether the stored energy mechanism is charged or discharged; and a third indicator structured to indicate whether or not the electrical switching apparatus is ready to close the separable contacts.

The third indicator may comprise a ready-to-close flag and a linkage assembly, wherein the linkage assembly includes a plurality of linking elements structured to operatively couple the ready-to-close flag to the primary latch. The ready-to-close flag may be structured to move between a first position in which the ready-to-close flag indicates that the electrical switching apparatus is not ready to close, and a second position in which the ready-to-close flag indicates that the electrical switching apparatus is ready to close. The plurality of linking elements may include a latch extension, a latch-to-close link, an opening actuator, a close block transfer link, and a ready-to-close flag link. The latch extension may be structured to extend outwardly from the primary latch. The latch-to-close link may interconnect the latch extension and the opening actuator. The ready-to-close flag link may be cooperable with the opening actuator, the first indicator, and the close block transfer link to move the ready-to-close flag between the first position and the second position.

The ready-to-close flag may be structured to be disposed in the second position only when the separable contacts are open, the primary latch is disposed in the latched position, and the stored energy mechanism is charged.

The opening actuator may comprise a generally planar portion and an extension extending outwardly from the generally planar portion, and the latch-to-close link may include a first end and a second end disposed opposite and distal from the first end of the latch-to-close link, wherein the first end of the latch-to-close link is coupled to the latch extension, and the second end of the latch-to-close link is coupled to the extension of the open actuator. The generally planar portion may include an aperture, and the opening actuator may further comprise an open button and a biasing element, wherein the open button is pivotally disposed in the aperture of the generally planar portion. The open button may be movable between an unactuated position and an actuated position, wherein the biasing element biases the opening button toward the unactuated position. The opening button may be movable both with, and independently with respect to, the generally planar portion, wherein the generally planar portion is structured not to move. The opening button may be structured to move independently with respect to the generally planar portion unless the primary latch of the electrical switching apparatus moves. The generally planar portion and the opening button may be structured to move together to open the electrical switching apparatus when the primary latch moves.

As another aspect of the disclosed concept, an electrical switching apparatus comprises: a housing; separable contacts enclosed by the housing; an operating mechanism for opening and closing the separable contacts, the operating mechanism comprising a stored energy mechanism and a primary latch, the primary latch being pivotable between a latched position corresponding to the stored energy mechanism being chargeable and an unlatched position corresponding to the stored energy mechanism being discharged; and a status indicating assembly comprising: a first indicator for indicating whether the separable contacts are open or closed, a second indicator for indicating whether the stored energy mechanism is charged or discharged, and a third indicator for indicating whether or not the electrical switching apparatus is ready to close the separable contacts.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
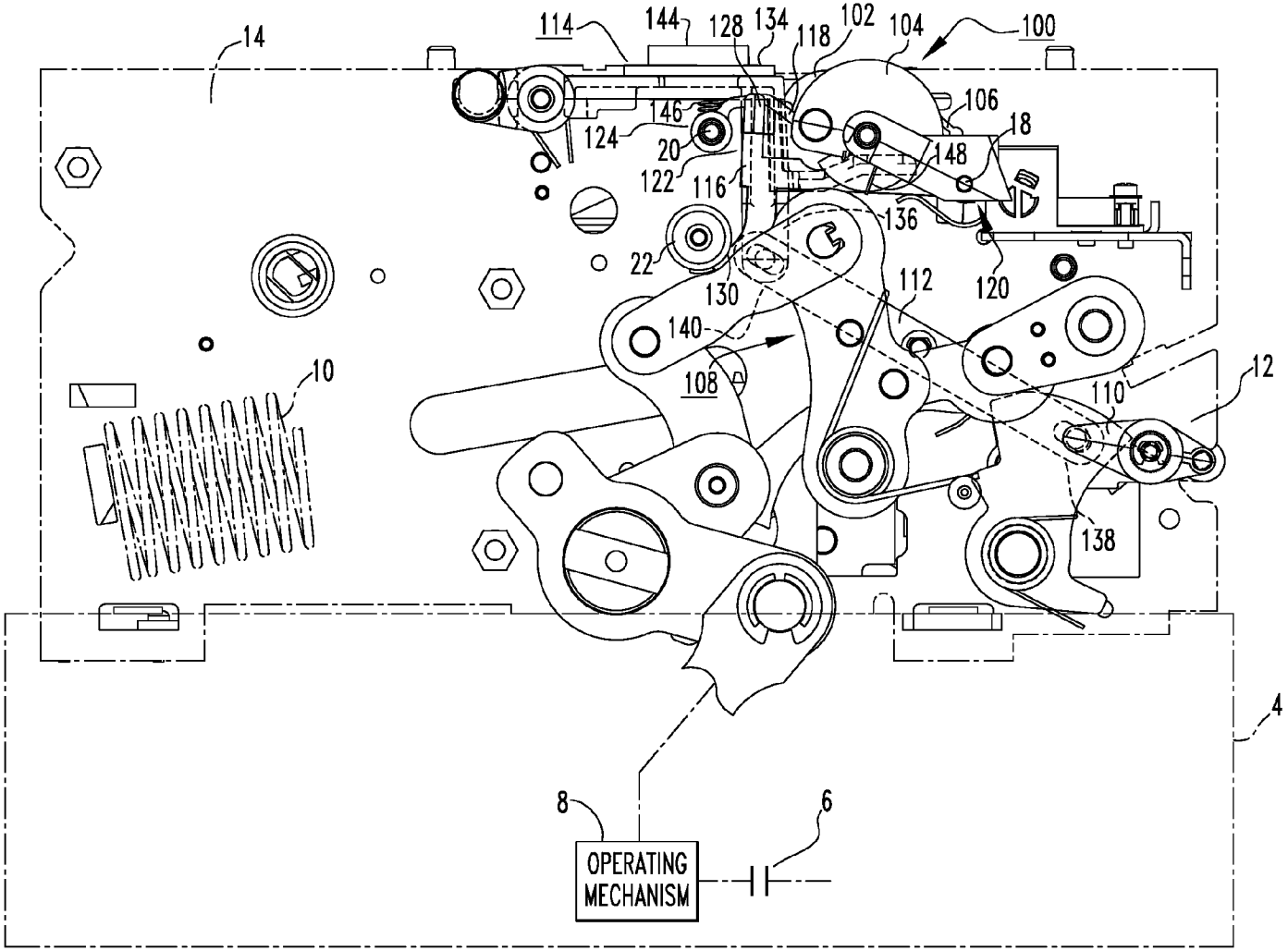
FIG. 1 is a side elevation view of a portion of a circuit breaker and a status indicating assembly therefor, in accordance with the disclosed concept, with the circuit breaker housing and hidden components being shown in simplified form.

Directional phrases used herein, such as, for example, left, right, up, down, clockwise, counterclockwise, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a status indicating assembly 100 for an electrical switching apparatus such as, for example and without limitation, a circuit breaker 2 (partially shown in simplified form in FIG. 1). The circuit breaker 2 includes a housing 4 (shown in phantom line drawing in FIG. 1), separable contacts 6 (shown in simplified form in FIG. 1) enclosed by the housing 4, and an operating mechanism 8 (shown in simplified form in FIG. 1) for opening and closing the separable contacts 6. The operating mechanism 8 includes a stored energy mechanism, which in the example of FIG. 1 is a closing spring 10 (partially shown in phantom line drawing). The operating mechanism 8 also includes a primary latch 12, which is pivotable between a latched position (see, for example, FIGS. 1, 4, 5A, 5C, 6, 7A, 7C, 8, 9A and 9C) corresponding to the stored energy mechanism 10 (FIG. 1) being discharged, and an unlatched position (see, for example, FIGS. 2, 3A, 3C, 10 and 11) corresponding to the stored energy mechanism 10 being discharged. In the example shown and described herein, the circuit breaker housing 4 further includes a pair of opposing side plates 14,16, and the status indicating assembly 100 is substantially disposed between the side plates 14,16, as best shown in the top plan views of FIGS. 3B, 5B, 7B and 9B.

Figure 4:
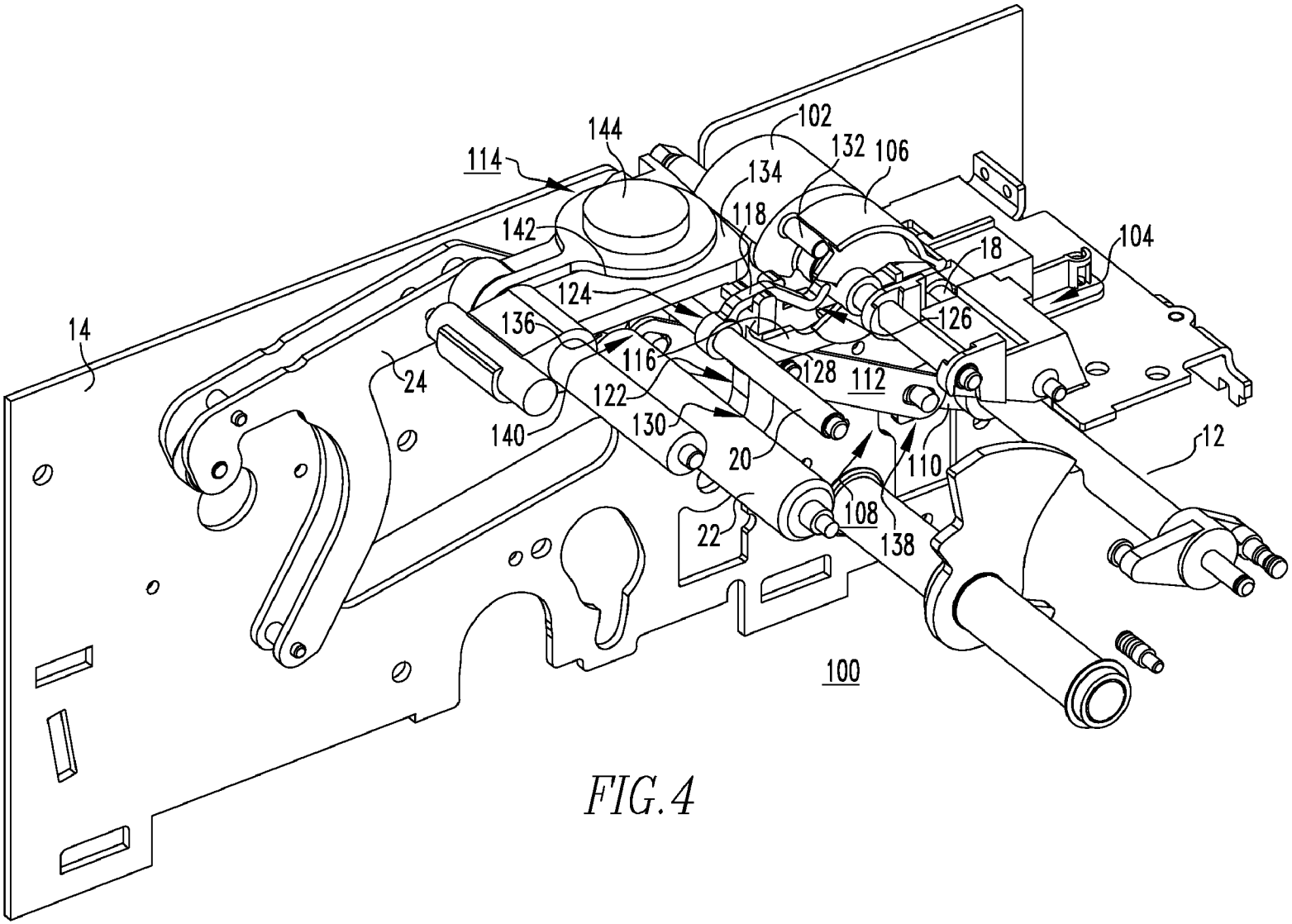
FIG. 4 is an isometric view of the status indicating assembly of FIGS. 3A-3C, shown in the position corresponding to the circuit breaker being charged and open.
Figure 5A:
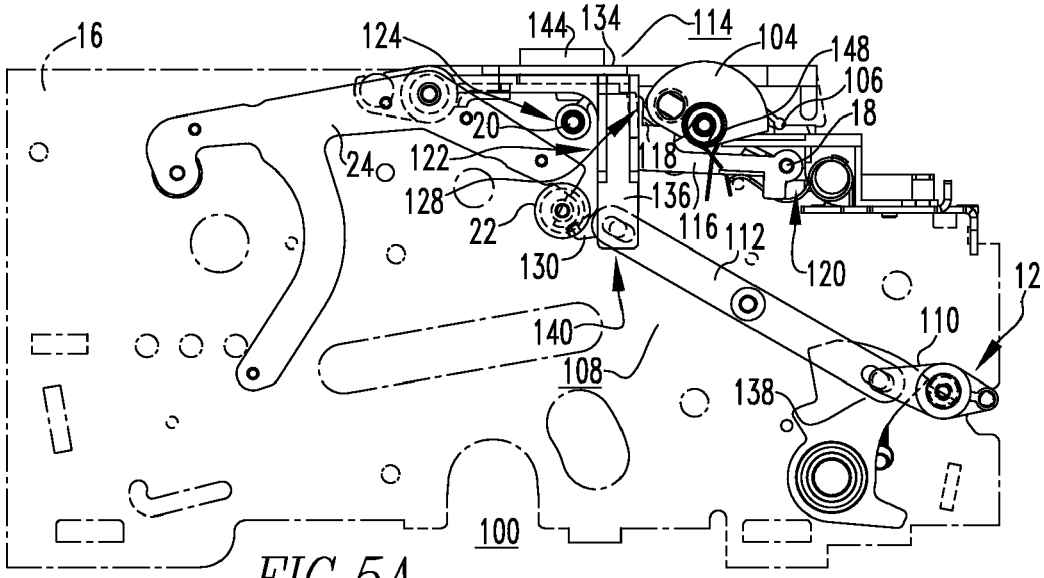
FIGS. 5A, 5B and 5C are left side elevation, top plan and right side elevation views, respectively, of the status indicating assembly of FIG. 4.
Figure 5B:
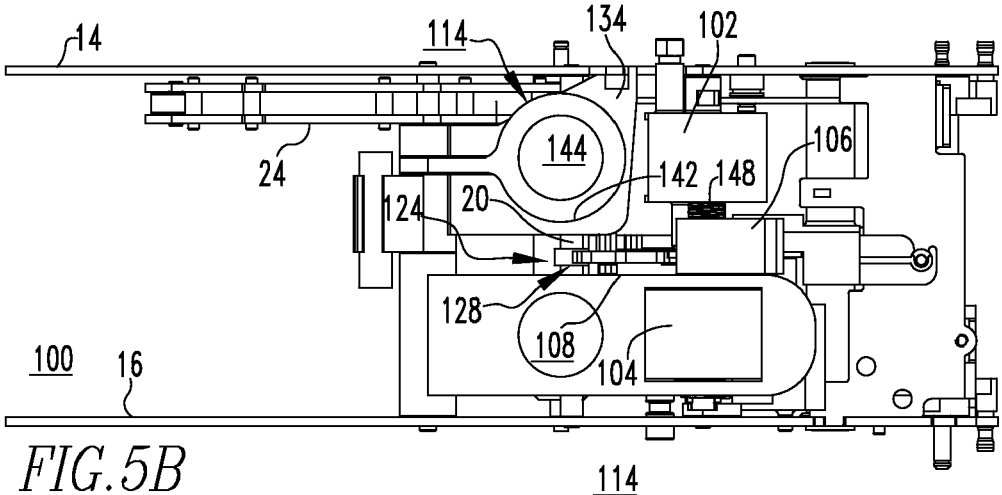
Figure 5C:
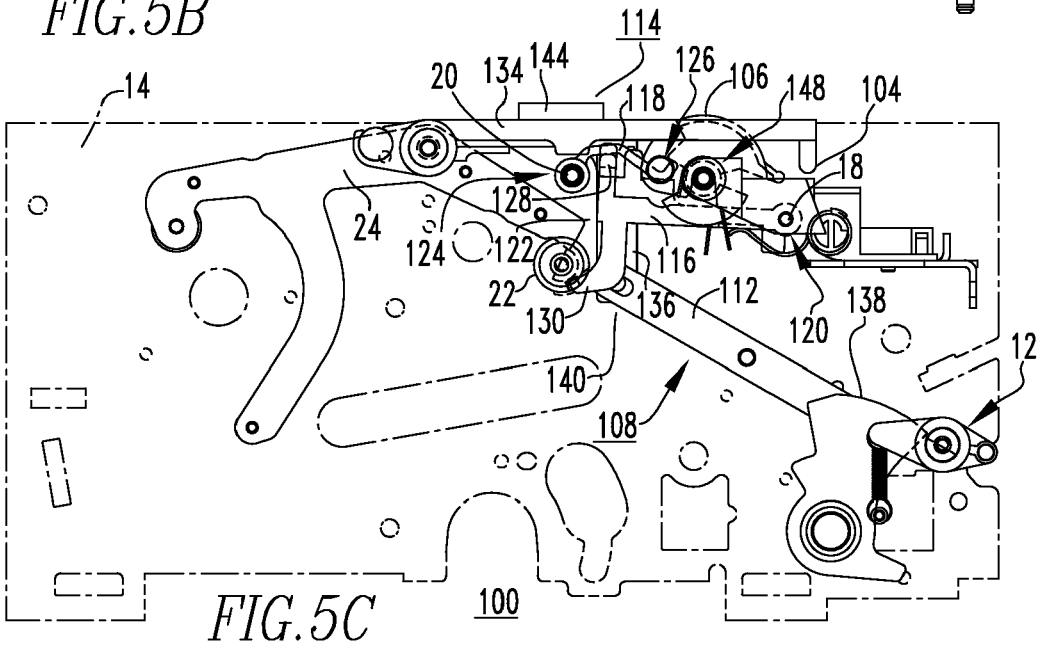

Traditional status indicating assemblies (not shown), at best, include two indicators, one for indicating the open or closed status of the circuit breaker separable contacts, and another for indicating the charged or discharged state of the stored energy mechanism. The disclosed status indicating assembly 100, on the other hand, includes not only a first indicator 102 for indicating whether the separable contacts 6 are opened or closed and a second indicator 104 for indicating whether the stored energy mechanism 10 is charged or discharged, but also further includes a third indicator 106 structured to indicate whether or not the circuit breaker 2 (FIG. 1) is truly ready to close the separable contacts 6 (FIG. 1). It will be appreciated that the circuit breaker 2 is truly ready to close only when: (1) the separable contacts 6 (FIG. 1) are open; (2) the stored energy mechanism 10 (FIG. 1) is charged; and (3) no safety interlock mechanism is preventing the circuit breaker 2 from closing. FIGS. 4-5C show the status indicating assembly 100 in the arrangement corresponding to the circuit breaker 2 (FIG. 1) being truly ready to close.

As will be described in greater detail hereinbelow, the third indicator, which in the example shown and described herein is a ready-to-close flag 106, has two inputs, namely the first indicator 102 (e.g., without limitation, open/closed flag), and the primary latch 12. Accordingly, certain safety interlock structures and features that are intended to prevent the example circuit breaker 2 from closing, perform their interlocking function by preventing the primary latch 12 from pivoting to the latched position (see, for example, FIGS. 1, 4, 5A, 5C, 6, 7A, 7C 8, 9A and 9C).

More specifically, the ready-to-close flag 106 includes a linkage assembly 108 having a plurality of linking elements 110, 112, 114, 116, 118, which operatively couple the ready-to-close flag 106 directly to the primary latch 12. Accordingly, a substantially direct indication of the status of the primary latch 12 is provided, wherein only one condition (e.g., separable contacts 6 open, stored energy mechanism 10 charged, and primary latch 12 latched, as previously discussed) is associated with readiness to close the circuit breaker 2. Additionally, among other benefits, the substantially direct linkage assembly 108 also provides design flexibility that increases the robustness of the overall circuit breaker design while minimizing possible detrimental affects on latch operation. That is, for example and without limitation, the likelihood of malfunction causing the circuit breaker 2 to fail to close is reduced, and the possibility of confusion as to whether such a failure to close is being caused by a malfunction or by a correctly operating interlock, is eliminated.

Figure 9A:
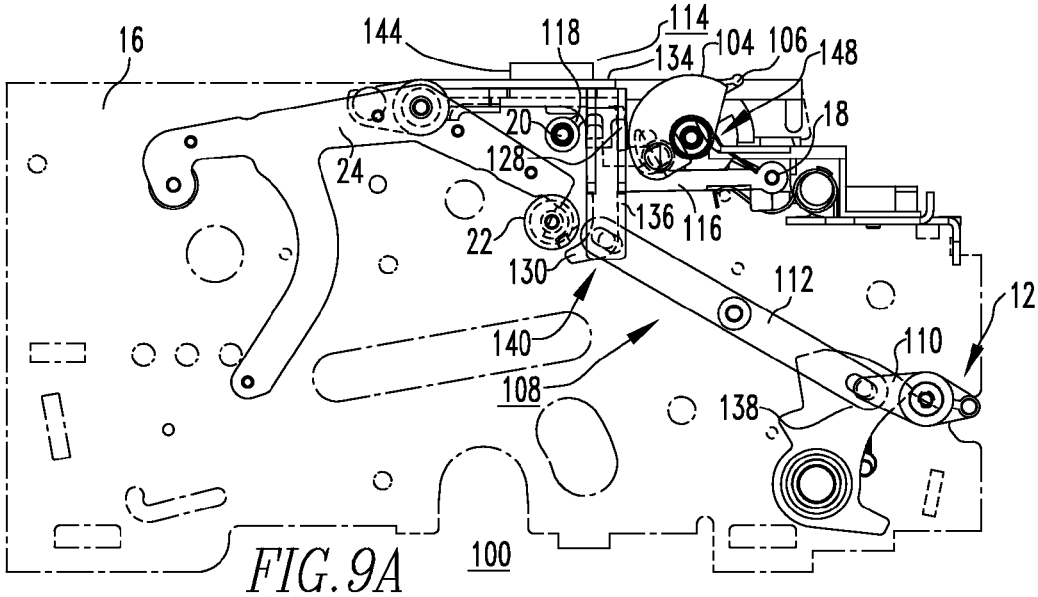
FIGS. 9A, 9B and 9C are left side elevation, top plan and right side elevation views, respectively, of the status indicating assembly of FIG. 8.
Figure 9B:
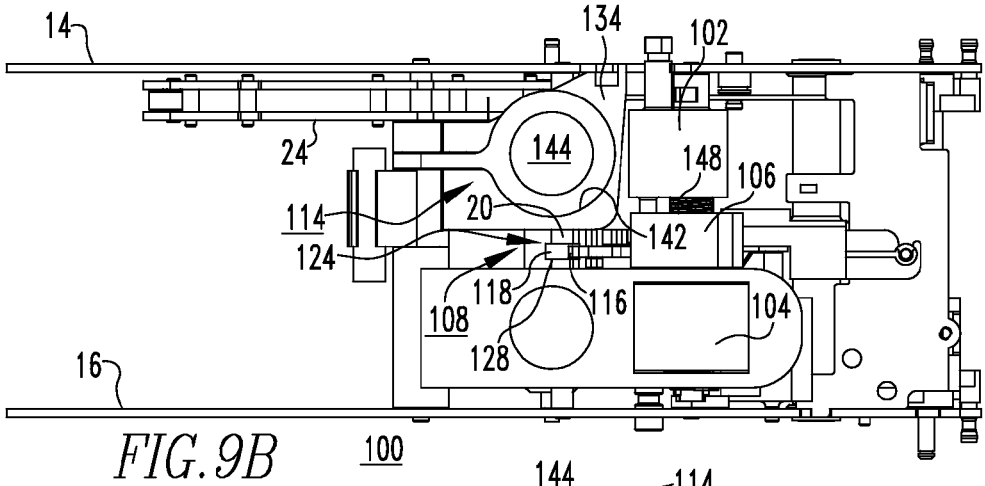
Figure 9C:
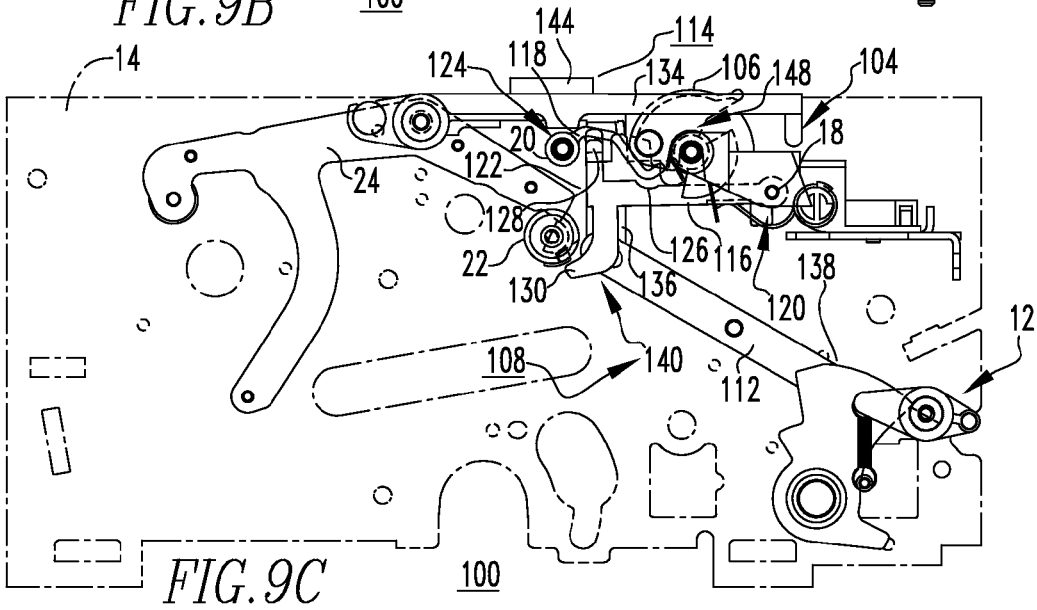
Figure 10:
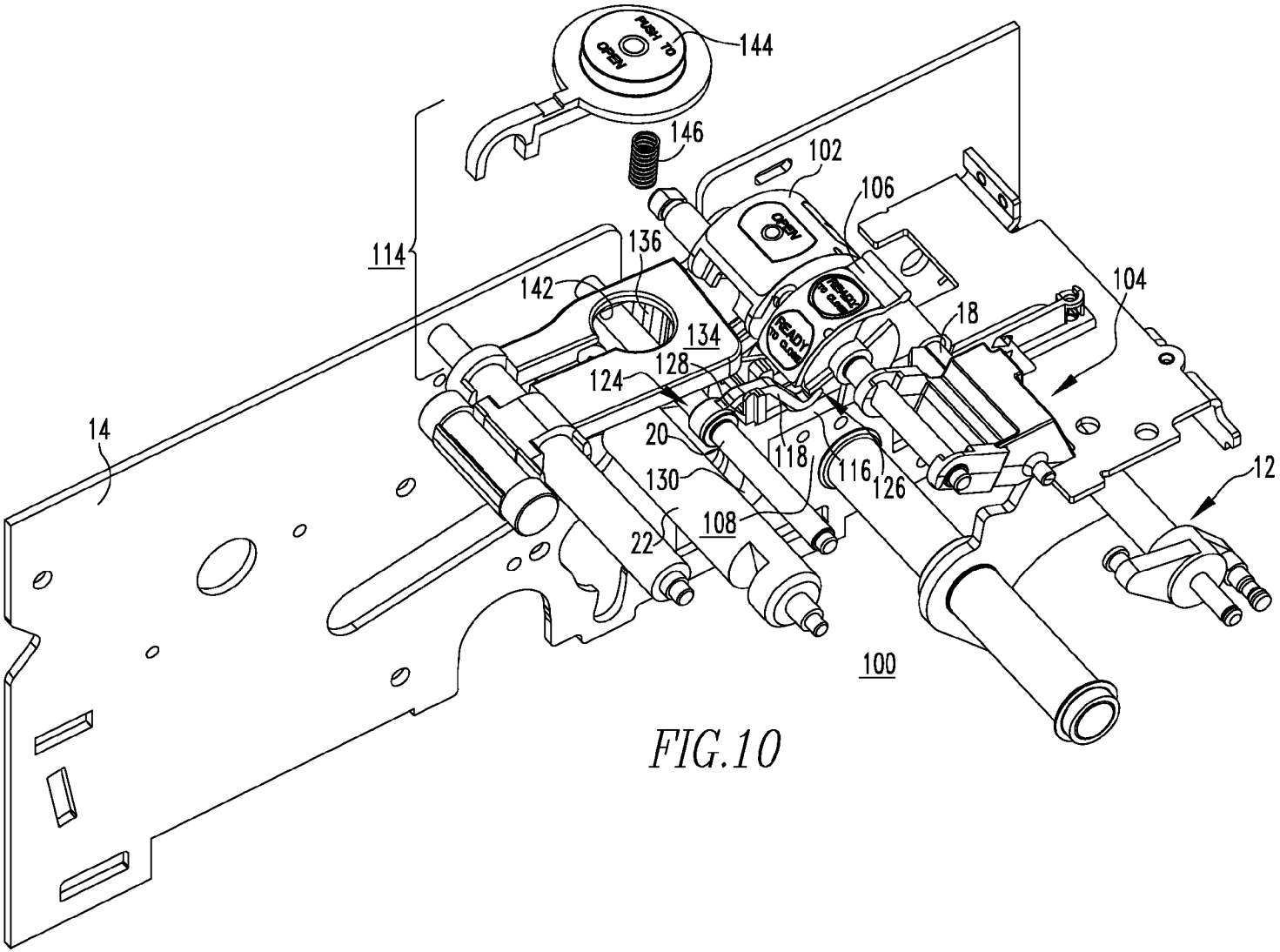
FIG. 10 is a partially exploded top isometric view of a portion of the status indicating assembly of FIGS. 9A-9C.
Figure 11:
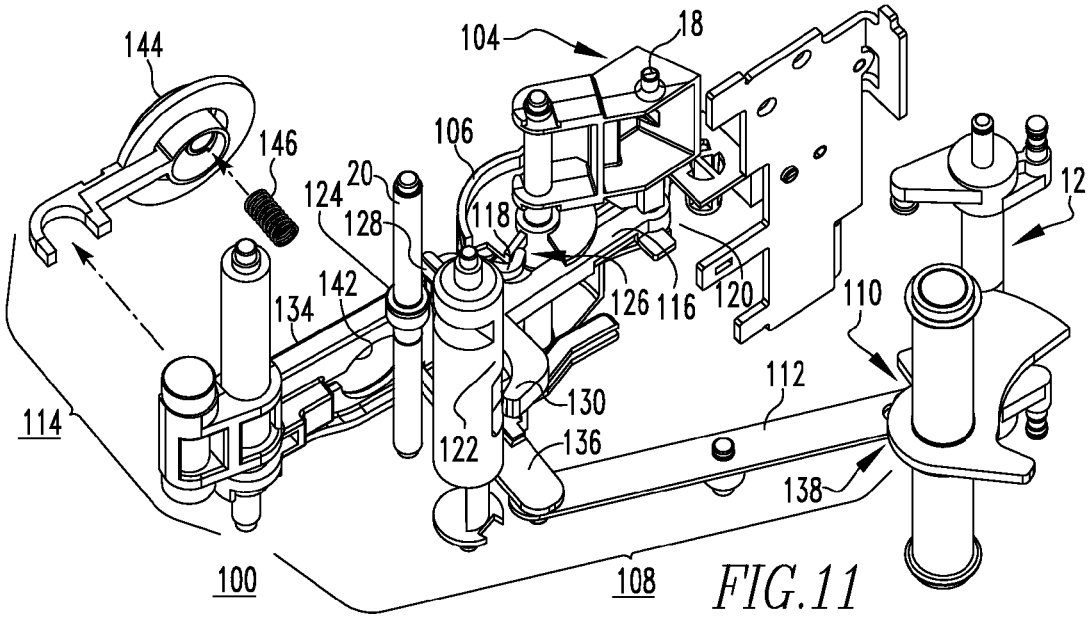
FIG. 11 is a partially exploded bottom isometric view of a portion of the status indicating assembly of FIG. 10.

The ready-to-close flag 106 moves between a first position (FIGS. 2-3C, 6-10 and 11) in which the ready-to-close flag 106 indicates that the circuit breaker 2 is not ready to close (see, for example and without limitation, the strike through of the word "ready" on the ready-to-close flag 106 of FIG. 10), and a second position (FIGS. 4-5C) in which the ready-to-close flag 106 indicates that the circuit breaker 2 is, in fact, ready to close. In accordance with the disclosed concept, the ready-to-close flag 106 is disposed in the second position of FIGS. 4-5C, and the circuit breaker 2 is truly ready to close, only when: (1) the separable contacts 6 (FIG. 1) are open; (2) the primary latch 12 is disposed in the latched position, as shown in FIGS. 5A-5C; and (3) the stored energy mechanism 10 (FIG. 1) is charged. Otherwise, the ready-to-close flag 106, will be disposed in the first position, shown in FIG. 10, in which it clearly indicates that the circuit breaker 2 is not ready to close.

The function of the status indicating assembly 100 and, in particular, the linkage assembly 108 thereof, will now be described in greater detail. Specifically, the linkage assembly 108 of the example status indicating assembly 100 employs five linking elements, a latch extension 110, a latch-to-close link 112, an opening actuator 114, a closed block transfer link 116, and a ready-to-close flag link 118. It will, however, be appreciated that any know or suitable alternative number, type and/or configuration of linking elements could be employed without departing from the scope of the disclosed concept. As shown, for example, in FIGS. 2 and 3A, the latch extension 110 preferably comprises a mold over feature coupled to and extending outwardly from the primary latch 12 of the circuit breaker 2 (FIG. 1). The latch-to-close link 112 interconnects the latch extension 110 and the opening actuator 114. The ready-to-close flag link 118 is cooperable with the opening actuator 114, the first indicator 102 (e.g., without limitation, open/closed flag) as well as the close block transfer link 116. In this manner, a variety of different inputs and conditions cause the linkage assembly 108 to correspondingly move the ready-to-close flag 106 between the first (not ready to close) and second (ready to close) positions.

Figure 2:
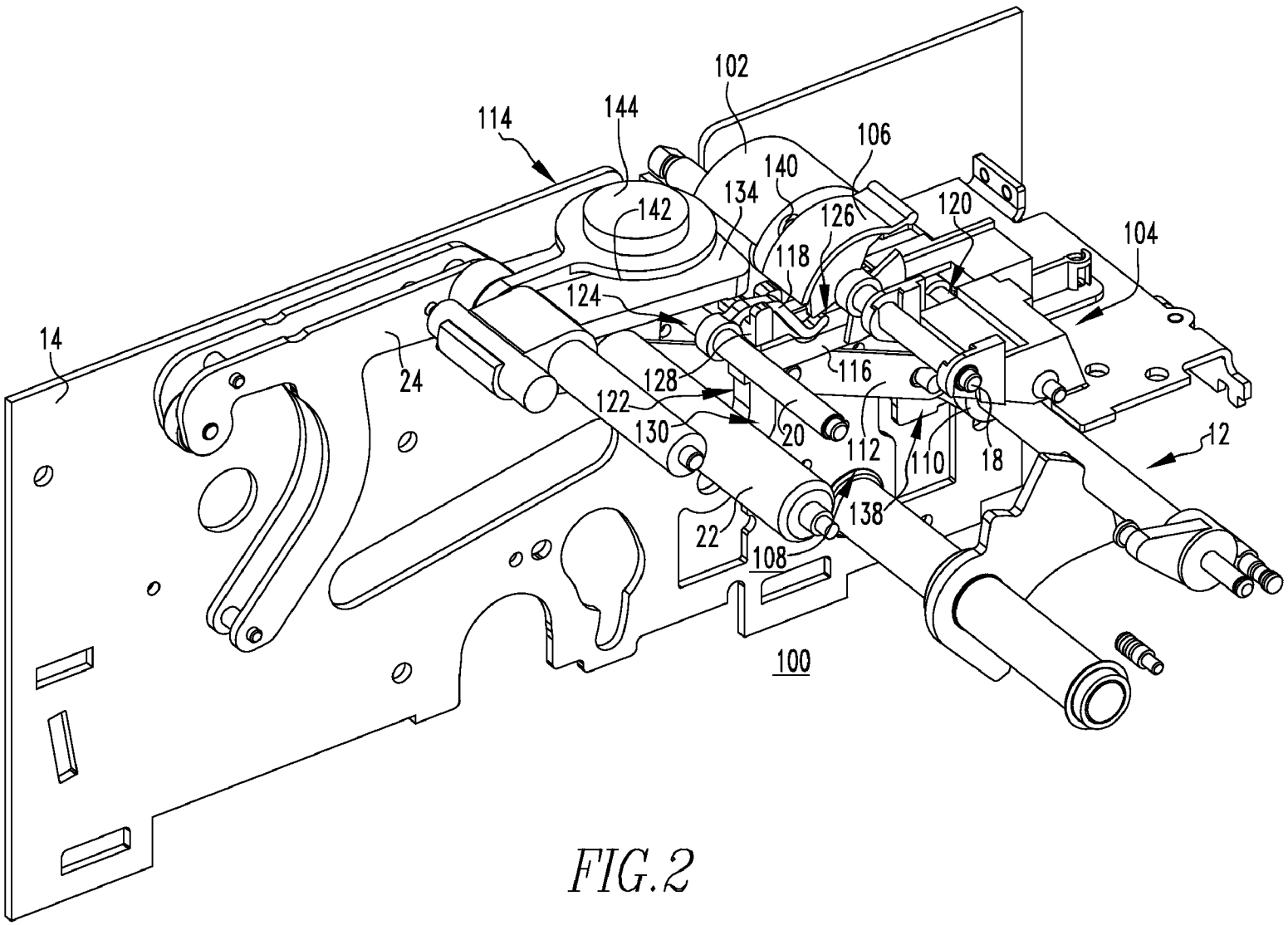
FIG. 2 is an isometric view of the status indicating assembly of FIG. 1, shown in the position corresponding to the circuit breaker being discharged and open.
Figure 3A:
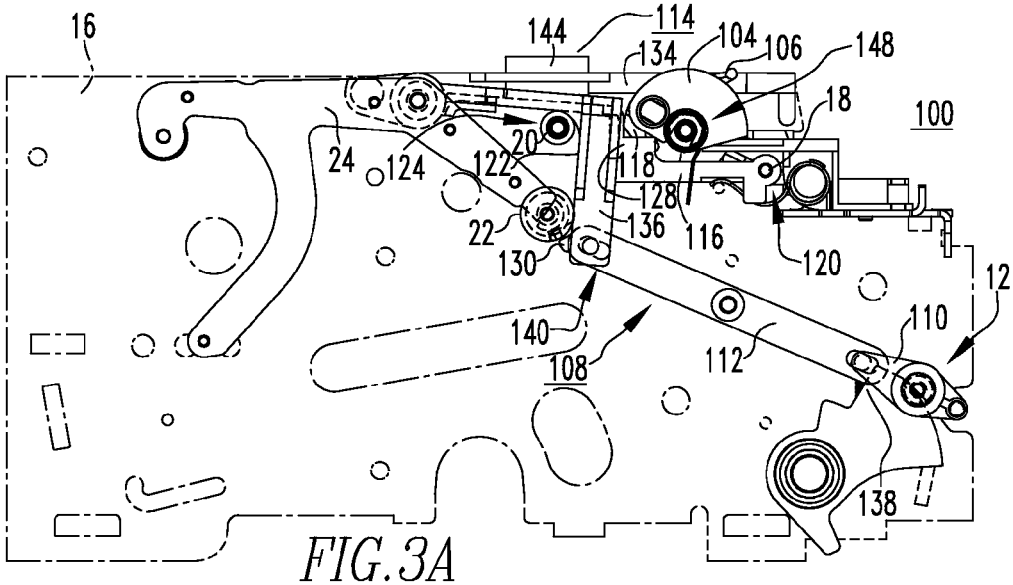
FIGS. 3A, 3B and 3C are left side elevation, top plan and right side elevation views, respectively, of the status indicating assembly of FIG. 2.
Figure 3B:
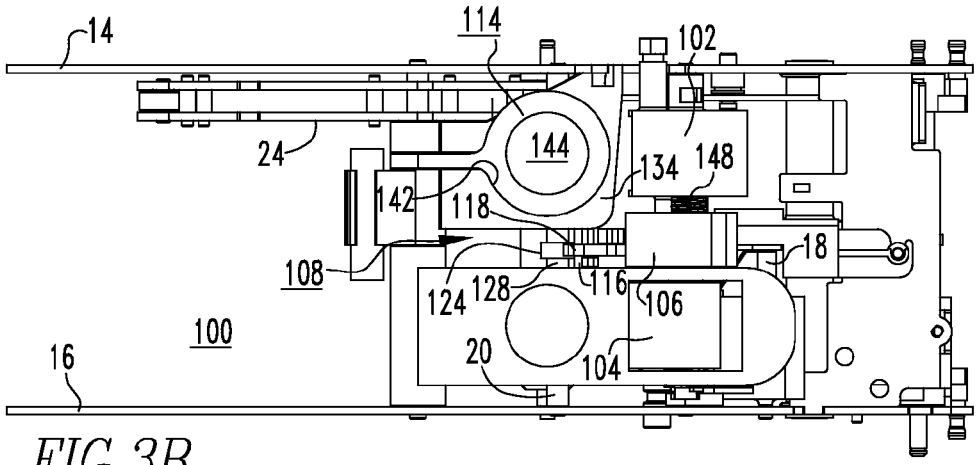
Figure 3C:
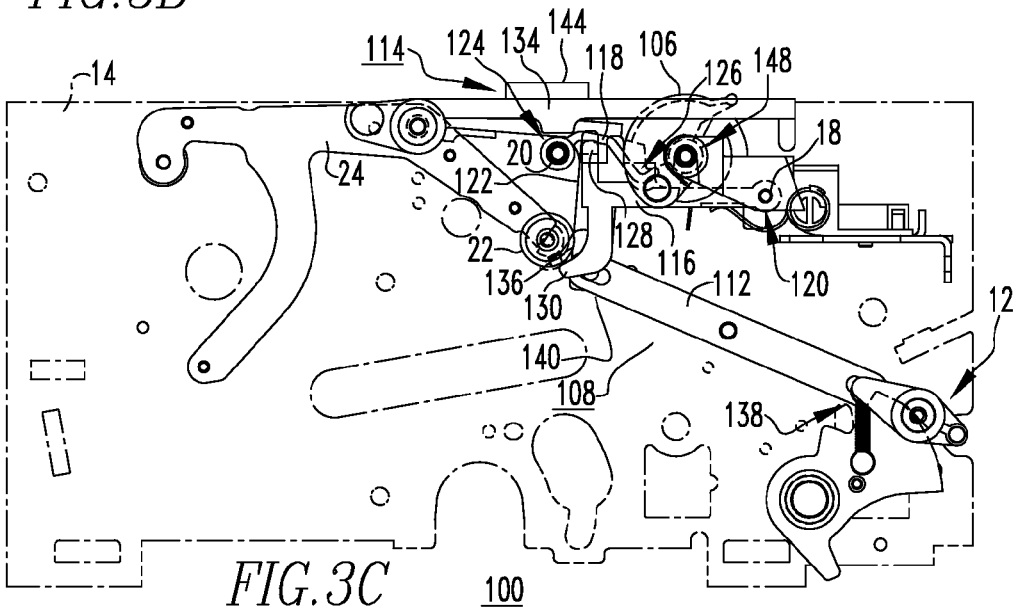

As shown, for example, in FIG. 3C, the close block transfer link 116 of the status indicating assembly 100 preferably includes a first end 120 pivotally coupled to a first pivot pin 18, and a second end 122 extending outwardly from the first pivot pin 18 in a first direction. The ready-to-close flag link 118 preferably includes a first end 124 pivotally coupled to a second pivot pin 20, and a second end 126 extending outwardly from the second pivot pin 20 in a second direction, which is generally opposite the first direction, as shown. The first and second pivot pins 18,20 preferably extend between the first and second side plates 14,16 of the circuit breaker 2 (FIG. 1), as shown in FIG. 3B. As a result of this opposing relationship, the second end 126 of the close block transfer link 116 cooperates with the ready-to-close flag link 118 at or about the first end 124 of the ready-to-close flag link 118, as best shown in FIGS. 2, 4, 6, 8 and 10.

The circuit breaker operating mechanism 8 (FIG. 1) further includes a pivotal close D-shaft 22 and a close latch 24 (both shown, for example, in FIG. 2). The pivotal close D-shaft 22 pivots between a latched position corresponding to the close latch 24 being latched, as shown in FIGS. 4-5C and 8-9C, and an unlatched position corresponding to the close latch 24 being unlatched, as shown in FIGS. 2-3C and 6-7C. The second end 122 of the example close block transfer link 116 includes a first portion 128 structured to engage the ready-to-close flag link 118, as previously discussed, and a second portion 130, which is structured to engage the pivotal close D-shaft 22, as best shown in FIG. 5C. Specifically, when the stored energy mechanism 10 (FIG. 1) is charged, the separable contacts 6 (FIG. 1) are open, and the primary latch 12 is disposed in the latched position (see, for example, FIG. 5C), the second portion 130 of the second end 122 of the close block transfer link 116 engages and holds the pivotal close D-shaft 22 in the latched position, as shown. Simultaneously, the first portion 128 of the second end 122 of the second close block transfer link 116 engages and pivots (e.g., counterclockwise about pivot pin 20, from the perspective of FIG. 5C) the ready-to-close flag link 118. This, in turn, causes the second end 126 of the ready-to-close flag link 118 to engage and move the ready-to-close flag 106 to the second position of FIGS. 4-5C. This is the only circuit breaker arrangement in which the circuit breaker 2 is truly ready to be closed and, therefore, is the only situation in which the ready-to-close flag 106 of the status indicating assembly 100 will provide the "ready to close" indication. Under all other circumstances, the ready-to-close flag 106 will be disposed in the first position, shown in FIG. 10, indicating that the circuit breaker 2 is not ready to be closed.

One non-limiting circumstance in which the circuit breaker 2 (FIG. 1) is not ready to close is shown in FIGS. 2-3C, which respectively show the circuit breaker 2 and status indicating assembly 100 therefor disposed in the positions corresponding to the stored energy mechanism 10 (FIG. 1) being discharged and the separable contacts 6 (FIG. 1) being open. Additionally, as best shown in FIGS. 3A and 3C, the pivotal close D-shaft 22 is disposed in the unlatched position, such that the close latch 24 is unlatched.

FIGS. 4-5C, as previously discussed, respectively show the arrangement of the status indicating assembly 100 when the stored energy mechanism 10 (FIG. 1) of the circuit breaker 2 (FIG. 1) is charged, the separable contacts 6 (FIG. 1) are open, and the primary latch 12 is latched. As previously noted hereinabove, this is the only circumstance in which the ready-to-close flag 106 indicates that the circuit breaker 2 (FIG. 1) is, in fact, ready-to-close. As shown in FIG. 4, in addition to the aforementioned linkage assembly 108 input to the ready-to-close flag 106, a second input is provided by way of a protrusion 132 extending laterally outwardly from the open/closed flag 102. Specifically, the open/closed flag 102 pivots between the open position, shown in FIG. 4 (see also FIG. 10) in which it indicates that the separable contacts 6 (FIG. 1) are open, and the closed position (FIGS. 6-9C and 11) in which it indicates that the separable contacts 6 (FIG. 1) are closed. Accordingly, as the open/closed flag 102 moves to the open position, the protrusion 132 engages and moves the ready-to-close flag 106 toward the second position, as best shown in FIG. 4. In this manner, the open/closed flag 102, and in particular, the protrusion 132 thereof, serves as a second input to the ready-to-close flag 106 for purposes of indicating whether or not the circuit breaker 2 (FIG. 1) is ready to close.

Figure 12:
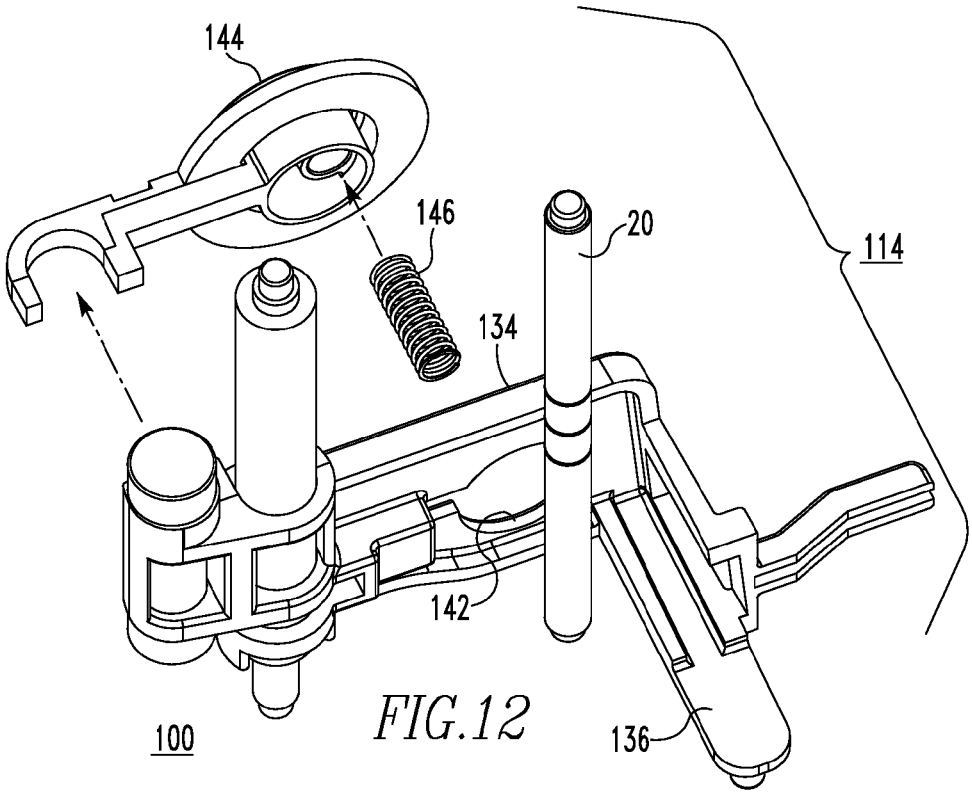
FIG. 12 is a partially exploded bottom isometric view of the opening button assembly of the status indicating assembly of FIG. 11.

The opening actuator 114 is another unique feature of the disclosed status indicating assembly 100. Specifically, as best shown in the partially exploded views of FIGS. 11 and 12, the opening actuator 114 preferably includes a generally planar portion 134 and an extension 136, which extends outwardly (e.g., downwardly from the perspective of FIGS. 11 and 12)

from the generally planar portion 134. The second end 140 of the latch-to-close link 112 is coupled to the extension 136 of the opening actuator 114 opposite the first end 138, which is coupled to the latch extension 110. The generally planar portion 134 of the example opening actuator 114 includes an aperture 142. An open button 144 is pivotally disposed in the aperture 144, as shown in FIGS. 2, 4, 6, 8 and 10. The open button 144 is movable between an unactuated position and an actuated position, in which it is depressed (e.g., moved downwards from the perspective of FIGS. 11 and 12). A biasing element, which in the example shown and described herein is a spring 146, biases the open button 144 toward the unactuated position. Accordingly, it will be appreciated that the opening button 144 is movable both with, and independently with respect to, the generally planar portion 134 of the opening actuator 114. Therefore, in operation, unless the primary latch 12 of the circuit breaker 2 (FIG. 1) moves, the generally planar portion 134 does not move and the opening button 144 is movable independently with respect to the generally planar portion 134. In other words, the generally planar portion 134 (e.g., outer portion) of the opening actuator 114 can independently provide the status of the primary latch 12, if desired. On the other hand, when the primary latch 12 moves, the generally planar portion 134 and opening button 144 of the opening actuator 114 are movable together to open the circuit breaker 2 (FIG. 1).

The ready-to-close flag 106 of the example status indicating assembly 100 includes a spring 148, best shown in the top plan views of FIGS. 3B, 5B, 7B and 9B. The spring 148 biases the ready-to-close flag 106 toward the first (e.g., not ready-to-close) position (best shown in FIG. 10). Accordingly, unless the open/closed flag 102 and/or linkage assembly 108 (specifically ready-to-close flag link 118) are engaging and moving (e.g., pivoting clockwise from the perspective of the figures shown herein) the ready-to-close flag 106 to overcome the spring bias and position the ready-to-close flag 106 in the second position of FIGS. 4-5C, the ready-to-close flag 106 will be disposed in the first or not ready to close position, shown in FIG. 10.

It will be appreciated that a variety of conditions of the example status indicating assembly 100 will, in effect, act as an interlock and cause the ready-to-close flag 106 to be disposed in the first position indicating that the circuit breaker 2 is not ready to close. For example and without limitation, when the close block transfer link 116 is depressed (e.g., moved downwardly from the perspective of the figures shown and described herein), the ready-to-close flag 106 is disposed in the first position. This is because the close block transfer link 116 being depressed allows the ready-to-close flag link 118 to pivot (e.g., clockwise about pivot pin 20 from the perspective of the figures shown and described herein) causing the second end 126 of the ready-to-close flag link 118 to also move downward, thereby releasing pressure on the ready-to-close flag 106. Consequently, the spring 148 pivots (e.g., counterclockwise from the perspective of the figures shown and described herein) the ready-to-close flag 106 to the first position. The various conditions under which the ready-to-close flag 106 is released to the first position, will now be described in greater detail.

Specifically, in FIGS. 2-3C, the generally planar portion 134 (e.g., outer portion) of the opening actuator 114 is depressing and moving downward (e.g., from the perspective of FIGS. 2, 3A and 3C) the second portion 128 of the second end 122 of the close block transfer link 116. This, in turn, moves the ready-to-close flag link 118 and, in particular, the second end 126 thereof correspondingly downward causing the spring-biased ready-to-close flag 106 to move to its default first position (e.g., not ready to close), as shown. FIGS. 2-3C correspond to the stored energy mechanism 10 (FIG. 1) of the circuit breaker 2 (FIG. 1) being discharged, the separable contacts 6 (FIG. 1) being open, and the primary latch 12 being unlatched.

Figure 6:
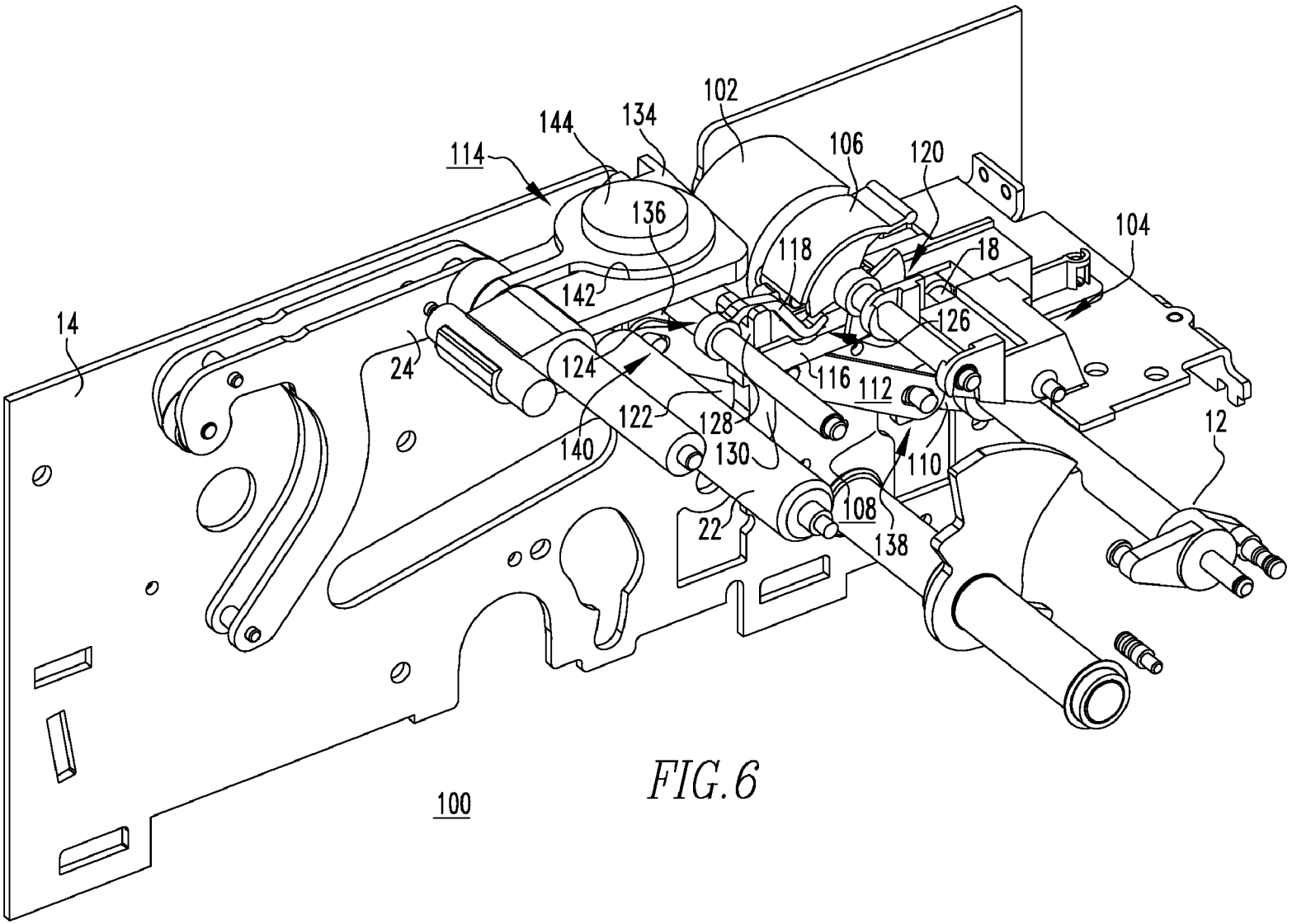
FIG. 6 is an isometric view of the status indicating assembly of FIGS. 5A-5C, shown in the position corresponding to the circuit breaker being discharged and closed.
Figure 7A:
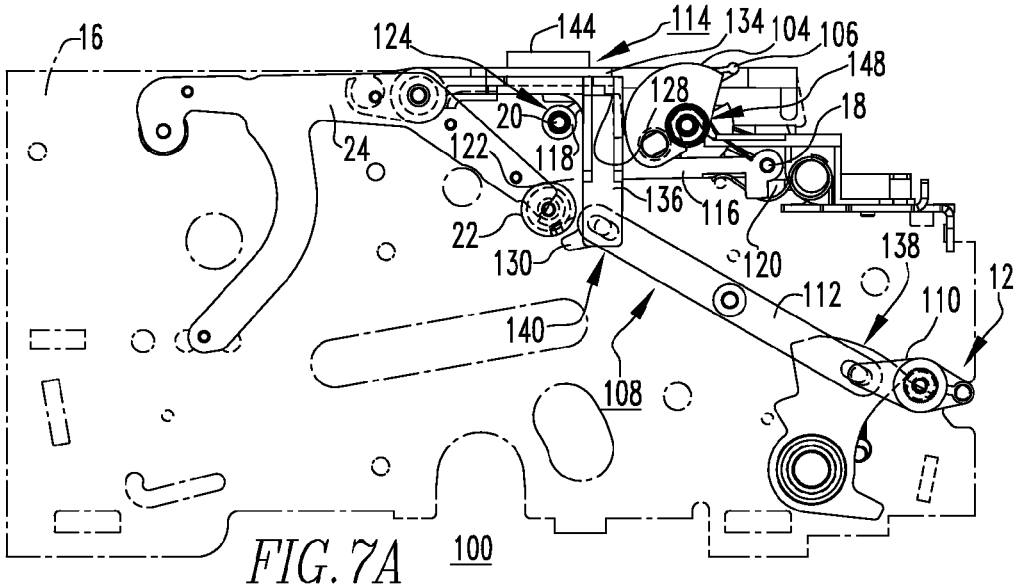
FIGS. 7A, 7B and 7C are left side elevation, top plan and right side elevation views, respectively, of the status indicating assembly of FIG. 6.
Figure 7B:
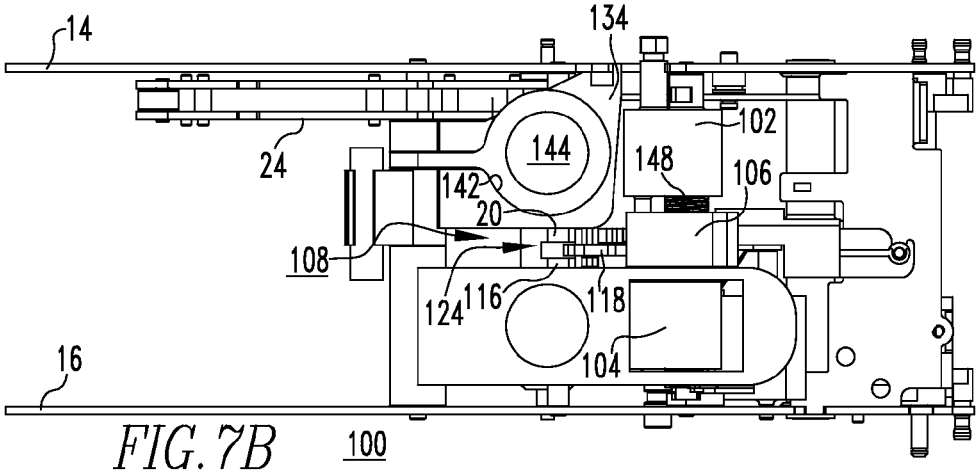
Figure 7C:
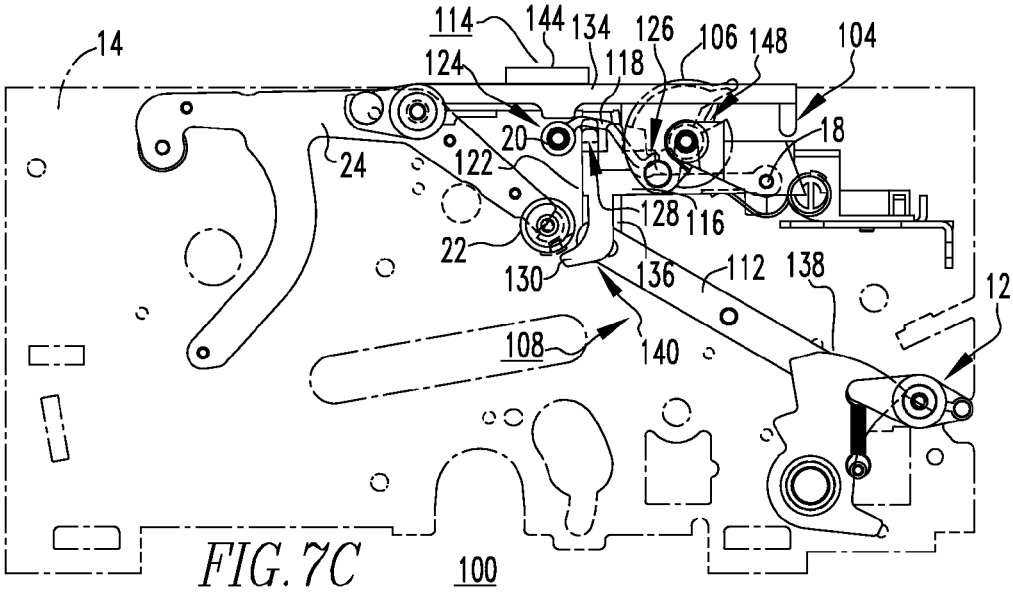

FIGS. 6-7C show another arrangement of the status indicating assembly 100 in which the open/closed indicator 102 is depressing (e.g., moving downward from the perspective of FIGS. 6-7C) the second portion 128 of the second end 122 of the close block transfer link 116 in a substantially similar matter to that previously discussed hereinabove with respect to FIGS. 2-3C. FIGS. 6-7C correspond to the stored energy mechanism 10 (FIG. 1) of the circuit breaker 2 (FIG. 1) being discharged, the separable contacts 6 (FIG. 1) being closed, and the primary latch 12 being disposed in a latched position.

Figure 8:
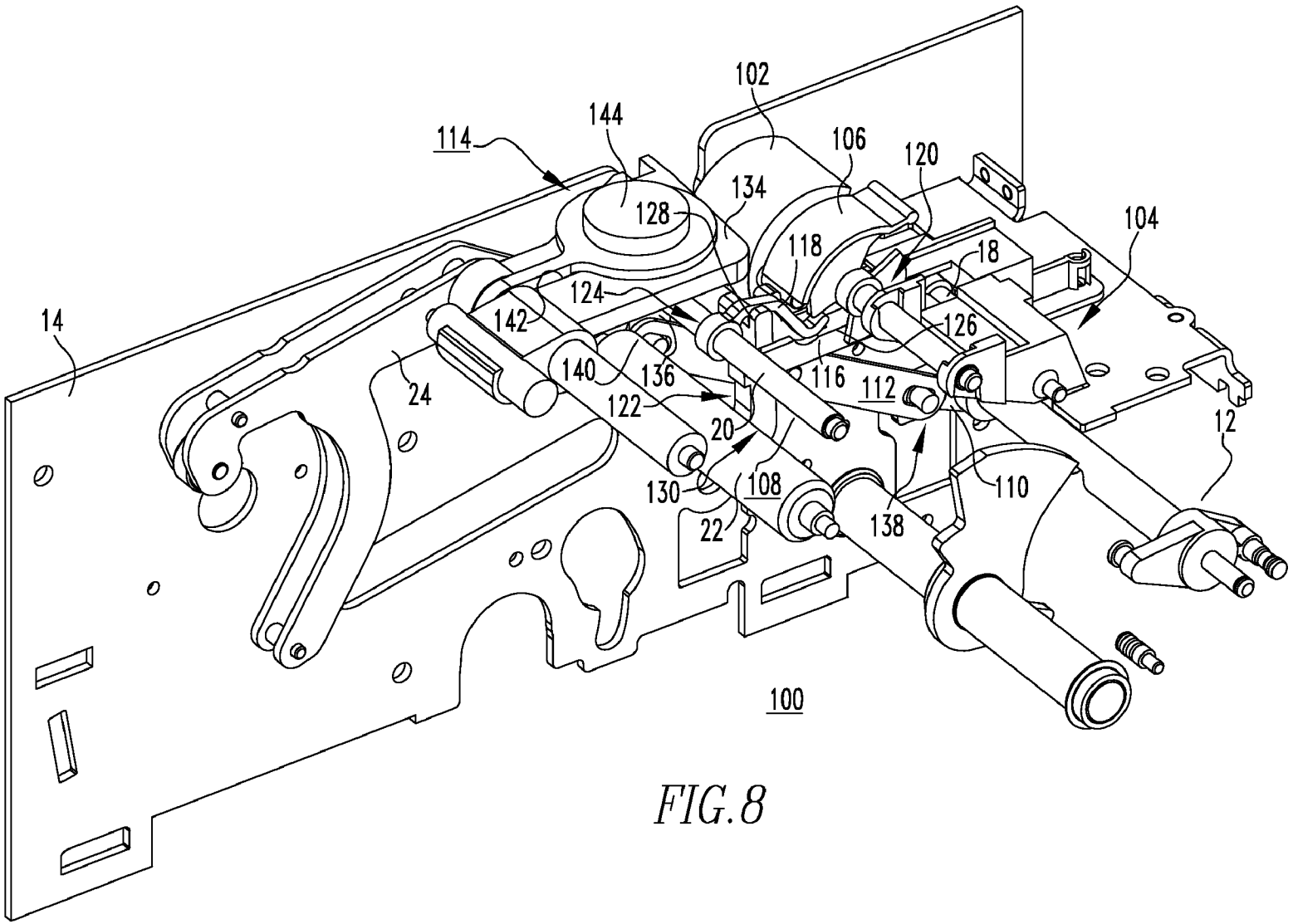
FIG. 8 is an isometric view of the status indicating assembly of FIGS. 7A-7C, shown in the position corresponding to the circuit breaker being charged and closed.

FIGS. 8-9C illustrate another, different circumstance, wherein the open/closed indictor 102 engages and depresses (e.g., moves downwardly from the perspective of FIGS. 8-9C) the second portion 128 of the second end 122 of the close block transfer link 116 and, in turn, moves the ready-to-close flag link 118 to release the ready-to-close flag 106. However, FIGS. 8-9C correspond to the stored energy mechanism 10 (FIG. 1) of the circuit breaker 2 (FIG. 1) being charged, the separable contacts 6 (FIG. 1) being closed, and the primary latch 12 being disposed in the latched position.

It will be appreciated, therefore, that the ready-to-close flag 106 of the status indicating assembly 100 will not indicate that the circuit breaker 2 is ready to close unless all three of the following criteria are met: (1) the separable contacts 6 of the circuit breaker 2 are open; (2) the stored energy mechanism 10 of the circuit breaker 2 is charged; and (3) the primary latch 12 of the circuit breaker 2 is disposed in the latched position. As previously discussed hereinabove, FIGS. 4-5C illustrate the arrangement of the status indicating assembly 100 when all of these criteria are met.

Accordingly, the disclosed status indicating assembly 100 provides an effective and robust linkage assembly 108 between the primary latch 12 of the circuit breaker 2 and a unique ready-to-close flag 106. The ready-to-close flag 106 provides an unambiguous substantially direct indication of when the circuit breaker 2 is truly ready to close, or alternatively under all other circumstances, an unambiguous indication that the circuit breaker 2 is not ready to be closed.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A status indicating assembly for an electrical switching apparatus, said electrical switching apparatus including a housing, separable contacts enclosed by the housing, and an operating mechanism for opening and closing said separable contacts, said operating mechanism comprising a stored energy mechanism and a primary latch, said primary latch being pivotable between a latched position corresponding to said stored energy mechanism being chargeable and an unlatched position corresponding to said stored energy mechanism being discharged, said status indicating assembly comprising:

a first indicator structured to indicate whether said separable contacts are open or closed;

a second indicator structured to indicate whether said stored energy mechanism is charged or discharged; and a third indicator structured to indicate whether or not said electrical switching apparatus is ready to close said separable contacts, said third indicator including a linkage assembly having a plurality of linking elements, wherein said first indicator provides a first input to said third indicator, and wherein said linking elements are structured to operatively couple said third indicator to said primary latch to provide a second input to said third indicator.

2. A status indicating assembly for an electrical switching apparatus, said electrical switching apparatus including a housing, separable contacts enclosed by the housing, and an operating mechanism for opening and closing said separable contacts, said operating mechanism comprising a stored energy mechanism and a primary latch, said primary latch being pivotable between a latched position corresponding to said stored energy mechanism being chargeable and an unlatched position corresponding to said stored energy mechanism being discharged, said status indicating assembly comprising:

a first indicator structured to indicate whether said separable contacts are open or closed;

a second indicator structured to indicate whether said stored energy mechanism is charged or discharged; and a third indicator structured to indicate whether or not said electrical switching apparatus is ready to close said separable contacts, wherein said third indicator comprises a ready-to-close flag and a linkage assembly; wherein said linkage assembly includes a plurality of linking elements structured to operatively couple said ready-to-close flag to said primary latch; and wherein said ready-to-close flag is structured to move between a first position in which said ready-to-close flag indicates that said electrical switching apparatus is not ready to close, and a second position in which said ready-to-close flag indicates that said electrical switching apparatus is ready to close.

3. The status indicating assembly of claim 2 wherein said plurality of linking elements includes a latch extension, a latch-to-close link, an opening actuator, a close block transfer link, and a ready-to-close flag link; wherein said latch extension is structured to extend outwardly from said primary latch; wherein said latch-to-close link interconnects said latch extension and said opening actuator; and wherein said ready-to-close flag link is cooperable with said opening actuator, said first indicator, and said close block transfer link to move said ready-to-close flag between said first position and said second position.

4. The status indicating assembly of claim 3 wherein said ready-to-close flag is structured to be disposed in said second position only when said separable contacts are open, said primary latch is disposed in said latched position, and said stored energy mechanism is charged.

5. The status indicating assembly of claim 3 wherein said close block transfer link includes a first end structured to be pivotally coupled to the housing, and a second end extending outwardly from the first end of said close block transfer link in a first direction; and wherein said ready-to-close flag link includes a first end structured to be pivotally coupled to the housing, and a second end structured to extend outwardly from the first end of said ready-to-close flag link in a second direction generally opposite said first direction; and wherein the second end of said close block transfer link cooperates with said ready-to-close flag link at or about the first end of said ready-to-close flag link.

6. The status indicating assembly of claim 5 wherein said operating mechanism further comprises a pivotal close D-shaft and a close latch; wherein said pivotal close D-shaft pivots between a latched position corresponding to said close latch being latched, and an unlatched position corresponding to said close latch being unlatched; wherein the second end of said close block transfer link includes a first portion structured to engage said ready-to-close flag link, and a second portion structured to engage said pivotal close D-shaft; wherein, when said stored energy mechanism is charged, said separable contacts are open, and said primary latch is disposed in said latched position, said second portion of the second end of said close block transfer link is structured to engage said pivotal close D-shaft, thereby holding said pivotal close D-shaft in said latched position; and wherein, when said second portion of the second end of said close block transfer link is engaging and holding said pivotal close D-shaft in said latched position, said first portion of the second end of said close block transfer link engages and pivots said ready-to-close flag link, thereby moving said ready-to-close flag to said second position.

7. The status indicating assembly of claim 3 wherein said first indicator is an open/closed flag; wherein said open/closed flag is structured to pivot between an open position in which said open/closed flag indicates said separable contacts are open, and a closed position in which said open/closed flag indicates said separable contacts are closed; wherein said open/closed flag includes a protrusion; and wherein, when said open/closed flag moves toward said open position, said protrusion engages and moves said ready-to-close flag toward said second position to indicate said electrical switching apparatus is ready to close.

8. The status indicating assembly of claim 3 wherein said opening actuator comprises a generally planar portion and an extension extending outwardly from said generally planar portion; wherein said latch-to-close link includes a first end and a second end disposed opposite and distal from the first end of said latch-to-close link; wherein the first end of said latch-to-close link is coupled to said latch extension; and wherein the second end of said latch-to-close link is coupled to said extension of said open actuator.

9. The status indicating assembly of claim 8 wherein said generally planar portion includes an aperture; wherein said opening actuator further comprises an open button and a biasing element; wherein said open button is pivotally disposed in the aperture of said generally planar portion; wherein said open button is movable between an unactuated position and an actuated position; and wherein said biasing element biases said opening button toward said unactuated position.

10. The status indicating assembly of claim 9 wherein said opening button is movable both with and independently with respect to said generally planar portion; wherein said generally planar portion is structured not to move, and said opening button is structured to move independently with respect to said generally planar portion unless said primary latch of said electrical switching apparatus moves; and wherein said generally planar portion and said opening button are structured to move together to open said electrical switching apparatus when said primary latch moves.

11. The status indicating assembly of claim 10 wherein said ready-to-close flag includes a spring; wherein said spring biases said ready-to-close flag toward said first position; wherein, when said stored energy mechanism is discharged and said separable contacts are open, said generally planar portion of said opening actuator engages and depresses said close block transfer link; wherein, when said stored energy mechanism is discharged and said separable contacts are closed, said open/closed flag engages and depresses said close block transfer link; wherein, when said stored energy mechanism is charged and said separable contacts are closed, said open/close flag engages and depresses said close block transfer link; and wherein, when said close block transfer link is depressed, said ready-to-close flag is disposed in said first position.

12. An electrical switching apparatus comprising:

a housing;

separable contacts enclosed by the housing;

an operating mechanism for opening and closing said separable contacts, said operating mechanism comprising a stored energy mechanism and a primary latch, said primary latch being pivotable between a latched position corresponding to said stored energy mechanism being chargeable and an unlatched position corresponding to said stored energy mechanism being discharged; and a status indicating assembly comprising:

a first indicator for indicating whether said separable contacts are open or closed, a second indicator for indicating whether said stored energy mechanism is charged or discharged, and a third indicator for indicating whether or not said electrical switching apparatus is ready to close said separable contacts, said third indicator including a linkage assembly having a plurality of linking elements, wherein said first indicator provides a first input to said third indicator, and wherein said linking elements operatively couple said third indicator to said primary latch to provide a second input to said third indicator.

13. An electrical switching apparatus comprising:

a housing;

separable contacts enclosed by the housing;

an operating mechanism for opening and closing said separable contacts, said operating mechanism comprising a stored energy mechanism and a primary latch, said primary latch being pivotable between a latched position corresponding to said stored energy mechanism being chargeable and an unlatched position corresponding to said stored energy mechanism being discharged; and a status indicating assembly comprising:

a first indicator for indicating whether said separable contacts are open or closed, a second indicator for indicating whether said stored energy mechanism is charged or discharged, and a third indicator for indicating whether or not said electrical switching apparatus is ready to close said separable contacts, wherein said third indicator of said status indicating assembly comprises a ready-to-close flag and a linkage assembly; wherein said linkage assembly includes a plurality of linking elements operatively coupling said ready-to-close flag to said primary latch; wherein said ready-to-close flag moves between a first position in which said ready-to-close flag indicates that said electrical switching apparatus is not ready to close, and a second position in which said ready-to-close flag indicates that said electrical switching apparatus is ready to close; and wherein said ready-to-close flag is disposed in said second position only when said separable contacts are open, said primary latch is disposed in said latched position, and said stored energy mechanism is charged.

14. The electrical switching apparatus of claim 13 wherein said plurality of linking elements includes a latch extension, a latch-to-close link, an opening actuator, a close block transfer link, and a ready-to-close flag link; wherein said latch extension extends outwardly from said primary latch; wherein said latch-to-close link interconnects said latch extension and said opening actuator; and wherein said ready-to-close flag link is cooperable with said opening actuator, said first indicator, and said close block transfer link to move said ready-to-close flag between said first position and said second position.

15. The electrical switching apparatus of claim 14 wherein said electrical switching apparatus is a circuit breaker; wherein the housing of said circuit breaker comprises a first side plate, a second side plate disposed opposite and distal from said first side plate, a first pivot pin extending between said first side plate and said second side plate, and a second pivot pin extending between said first side plate and said second side plate; wherein said close block transfer link of said status indicating assembly includes a first end pivotally coupled to said first pivot pin, and a second end extending outwardly from said first pivot pin in a first direction; wherein said ready-to-close flag link includes a first end pivotally coupled to said second pivot pin, and a second end extending outwardly from said second pivot pin in a second direction generally opposite said first direction; and wherein the second end of said close block transfer link cooperates with said ready-to-close flag link at or about the first end of said ready-to-close flag link.

16. The electrical switching apparatus of claim 15 wherein said operating mechanism of said circuit breaker further comprises a pivotal close D-shaft and a close latch; wherein said pivotal close D-shaft pivots between a latched position corresponding to said close latch being latched, and an unlatched position corresponding to said close latch being unlatched; wherein the second end of said close block transfer link includes a first portion engaging said ready-to-close flag link, and a second portion engaging said pivotal close D-shaft; wherein, when said stored energy mechanism is charged, said separable contacts are open, and said primary latch is disposed in said latched position, the second portion of the second end of said close block transfer link engages said pivotal close D-shaft, thereby holding said pivotal close D-shaft in said latched position; and wherein, when said second portion of the second end of said close block transfer link is engaging and holding said pivotal close D-shaft in said latched position, said first portion of the second end of said close block transfer link engages and pivots said ready-to-close flag link, thereby moving said ready-to-close flag to said second position.

17. The electrical switching apparatus of claim 14 wherein said first indicator is an open/closed flag; wherein said open/closed flag pivots between an open position in which said open/closed flag indicates said separable contacts are open, and a closed position in which said open/closed flag indicates said separable contacts are closed; wherein said open/closed flag includes a protrusion; and wherein, when said open/closed flag moves toward said open position, said protrusion engages and moves said ready-to-close flag toward said second position to indicate said electrical switching apparatus is ready to close.

18. The electrical switching apparatus of claim 14 wherein said opening actuator of said status indicating assembly comprises a generally planar portion and an extension extending outwardly from said generally planar portion; wherein said latch-to-close link includes a first end and a second end disposed opposite and distal from the first end of said latch-to-close link; wherein the first end of said latch-to-close link is coupled to said latch extension; and wherein the second end of said latch-to-close link is coupled to said extension of said open actuator; wherein said generally planar portion includes an aperture; wherein said opening actuator further comprises an open button and a biasing element; wherein said open button is pivotally disposed in the aperture of said generally planar portion; wherein said open button is movable between an unactuated position and an actuated position; and wherein said biasing element biases said opening button toward said unactuated position.

19. The electrical switching apparatus of claim 18 wherein said opening button is movable both with and independently with respect to said generally planar portion; wherein said generally planar portion does not to move, and said opening button moves independently with respect to said generally planar portion, unless said primary latch of said electrical switching apparatus moves; and wherein said generally planar portion and said opening button move together to open said electrical switching apparatus when said primary latch moves.

20. The electrical switching apparatus of claim 19 wherein said ready-to-close flag includes a spring; wherein said spring biases said ready-to-close flag toward said first position; wherein, when said stored energy mechanism is discharged and said separable contacts are open, said generally planar portion of said opening actuator engages and depresses said close block transfer link; wherein, when said stored energy mechanism is discharged and said separable contacts are closed, said open/closed flag engages and depresses said close block transfer link; wherein, when said stored energy mechanism is charged and said separable contacts are closed, said open/close flag engages and depresses said close block transfer link; and wherein, when said close block transfer link is depressed, said ready-to-close flag is disposed in said first position.

* * * * *